US007845642B2

(12) United States Patent
Krise

(10) Patent No.: US 7,845,642 B2
(45) Date of Patent: Dec. 7, 2010

(54) PICK-IT POKER

(75) Inventor: David A Krise, Spokane, WA (US)

(73) Assignee: Digideal Corporation, Spokane, WA (US)

( * ) Notice: Subject to any disclaimer, the term of this patent is extended or adjusted under 35 U.S.C. 154(b) by 295 days.

(21) Appl. No.: 12/251,875

(22) Filed: Oct. 15, 2008

(65) Prior Publication Data

US 2010/0090404 A1 Apr. 15, 2010

(51) Int. Cl.
*A63F 1/00* (2006.01)

(52) U.S. Cl. ..... 273/292; 273/274; 273/309; 463/13

(58) Field of Classification Search ..... 273/292, 273/274, 309; 463/13, 12
See application file for complete search history.

(56) References Cited

U.S. PATENT DOCUMENTS

| | | | |
|---|---|---|---|
| 2,519,681 | A | 8/1950 | Mages |
| 3,049,001 | A | 8/1962 | Mackay et al. |
| 3,070,087 | A | 12/1962 | Sittel |
| 3,181,351 | A | 5/1965 | Stauffer |
| 3,796,433 | A | 3/1974 | Fraley et al. |
| 4,072,310 | A | 2/1978 | Beam |
| 4,294,451 | A | 10/1981 | Wollner |
| 4,380,334 | A | 4/1983 | Minkoff et al. |
| 4,531,187 | A | 7/1985 | Uhland |
| 4,614,342 | A | 9/1986 | Takashima |
| 4,636,951 | A | 1/1987 | Harlick |
| 4,760,527 | A | 7/1988 | Sidley |
| 4,813,675 | A | 3/1989 | Greenwood |
| 4,926,327 | A | 5/1990 | Sidley |
| 5,022,653 | A | 6/1991 | Suttle et al. |
| 5,033,744 | A | 7/1991 | Bridgeman et al. |
| 5,046,736 | A | 9/1991 | Bridgeman et al. |
| 5,098,107 | A | 3/1992 | Boylan et al. |
| 5,141,234 | A | 8/1992 | Boylan et al. |
| 5,224,706 | A | 7/1993 | Bridgeman et al. |
| 5,242,163 | A | 9/1993 | Fulton |

(Continued)

FOREIGN PATENT DOCUMENTS

| | | | |
|---|---|---|---|
| GB | 2117546 | A | 10/1983 |

OTHER PUBLICATIONS

U.S. Appl. No. 12/176,248, 2009, Kuhn et al.

(Continued)

*Primary Examiner*—Gene Kim
*Assistant Examiner*—Michael D Dennis
(74) *Attorney, Agent, or Firm*—Farrell Patent Law PC; Mark Farrell

(57) ABSTRACT

A multi-stage card game includes stages at which each player selects which unrevealed cards are to be played. In one implementation, bets are received for at least some stages of a multi-stage poker-like game. Cards are dealt into an unrevealed dealer hand and an unrevealed player hand for each player. For at least one of the stages, each player selects one of the cards from the player's unrevealed hand to reveal in order to access a progression of payout schedules. Each player's hand accumulates player-selected cards across the stages of the game and across associated payout schedules, until all cards are revealed. A player's poker hand is then compared to the dealer's poker hand for potential payout. Opportunities for bonus bets are also interjected into implementations of the game.

1 Claim, 9 Drawing Sheets

U.S. PATENT DOCUMENTS

| | | | | |
|---|---|---|---|---|
| 5,255,915 | A | 10/1993 | Miller | |
| 5,332,219 | A | 7/1994 | Marnell, II et al. | |
| 5,377,973 | A | 1/1995 | Jones | |
| 5,377,993 | A | 1/1995 | Josephs | |
| 5,393,057 | A | 2/1995 | Marnell, II | |
| 5,407,199 | A | 4/1995 | Gumina | |
| 5,423,551 | A | 6/1995 | Stavinsky | |
| 5,496,032 | A | 3/1996 | Okada | |
| 5,511,781 | A | 4/1996 | Wood et al. | |
| 5,531,440 | A | 7/1996 | Dabrowski et al. | |
| 5,531,448 | A | 7/1996 | Moody | |
| 5,586,766 | A | 12/1996 | Forte et al. | |
| 5,586,936 | A | 12/1996 | Bennett et al. | |
| 5,613,912 | A | 3/1997 | Slater | |
| 5,630,586 | A | 5/1997 | Lowden | |
| 5,636,843 | A | 6/1997 | Roberts | |
| 5,651,548 | A | 7/1997 | French et al. | |
| 5,655,966 | A | 8/1997 | Werdin et al. | |
| 5,669,817 | A | 9/1997 | Tarantino | |
| 5,674,128 | A | 10/1997 | Holch et al. | |
| 5,687,968 | A | 11/1997 | Tarantino | |
| 5,735,742 | A | 4/1998 | French | |
| 5,743,800 | A | 4/1998 | Huard et al. | |
| 5,766,076 | A | 6/1998 | Pease et al. | |
| 5,770,533 | A | 6/1998 | Franchi | |
| 5,779,546 | A | 7/1998 | Meissner et al. | |
| 5,788,230 | A | 8/1998 | Krise et al. | |
| 5,788,574 | A | 8/1998 | Ornstein et al. | |
| 5,803,808 | A | 9/1998 | Strisower | |
| 5,831,527 | A | 11/1998 | Jones, II et al. | |
| 5,839,960 | A | 11/1998 | Parra et al. | |
| 5,845,907 | A | 12/1998 | Wells | |
| 5,868,392 | A | 2/1999 | Kraft | |
| 5,879,233 | A | 3/1999 | Stupero | |
| 5,909,876 | A | 6/1999 | Brown | |
| 5,919,090 | A | 7/1999 | Mothwurf | |
| 5,934,672 | A | 8/1999 | Sines et al. | |
| 5,934,998 | A | 8/1999 | Forte et al. | |
| 5,944,315 | A | 8/1999 | Mostashari | |
| 5,944,316 | A | 8/1999 | Hernandez | |
| 5,951,397 | A | 9/1999 | Dickinson | |
| 6,010,404 | A | 1/2000 | Walker et al. | |
| 6,093,101 | A | 7/2000 | Mourad | |
| 6,099,408 | A | 8/2000 | Schneier et al. | |
| 6,158,741 | A | 12/2000 | Koelling | |
| 6,165,069 | A | 12/2000 | Sines et al. | |
| 6,186,895 | B1 | 2/2001 | Oliver | |
| 6,200,218 | B1 | 3/2001 | Lindsay | |
| 6,203,008 | B1 | 3/2001 | Krise et al. | |
| 6,203,009 | B1 | 3/2001 | Sines et al. | |
| 6,217,447 | B1 | 4/2001 | Lofink et al. | |
| 6,270,404 | B2 | 8/2001 | Sines et al. | |
| 6,419,225 | B2 | 7/2002 | Sines et al. | |
| 6,419,226 | B2 | 7/2002 | Krise et al. | |
| 6,481,718 | B2 | 11/2002 | Koelling et al. | |
| 6,575,467 | B1 * | 6/2003 | Kal | 273/292 |
| 6,619,659 | B2 | 9/2003 | Krise et al. | |
| 6,641,137 | B2 | 11/2003 | Sines et al. | |
| 6,651,985 | B2 | 11/2003 | Sines et al. | |
| 6,722,974 | B2 | 4/2004 | Sines et al. | |
| 6,896,259 | B2 | 5/2005 | Sines et al. | |
| RE38,982 | E | 2/2006 | Forte et al. | |
| 7,048,629 | B2 | 5/2006 | Sines et al. | |
| 7,255,642 | B2 | 8/2007 | Sines et al. | |
| 7,389,990 | B2 * | 6/2008 | Mourad | 273/292 |

OTHER PUBLICATIONS

U.S. Appl. No. 12/192,751, 2008, Kuhn et al.
U.S. Appl. No. 12/248,891, 2008, Kuhn et al.
U.S. Appl. No. 11/100,795, 2006, Sines et al.
U.S. Appl. No. 11/591,144, 2007, Kuhn et al.
U.S. Appl. No. 11/590,954, 2007, Kuhn et al.
U.S. Appl. No. 11/591,145, 2007, Kuhn et al.
U.S. Appl. No. 11/591,072, 2006, Kuhn et al.
U.S. Appl. No. 11/642,404, 2006, Kuhn et al.
U.S. Appl. No. 11/642,580, 2006, Kuhn et al.
U.S. Appl. No. 12/072,020, 2008, Kuhn et al.
U.S. Appl. No. 12/077,074, 2008, Sines et al.
U.S. Appl. No. 12/072,028, 2008, Sines et al.
U.S. Appl. No. 12/077,078, 2008, Sines et al.
U.S. Appl. No. 12/077,080, 2008, Sines et al.
U.S. Appl. No. 10/858,160, 2005, Sines et al.
U.S. Appl. No. 11/055,589, 2005, Sines et al.
U.S. Appl. No. 12/176,248, 2008, Kuhn et al.
Updated Jul. 1, 2009, Digideal Corp, IDS.
U.S. Appl. No. 11/396,005, 2006, Sines et al.
U.S. Appl. No. 11/397,155, 2006, Sines et al.
U.S. Appl. No. 11/404,955, 2006, Sines et al.
U.S. Appl. No. 11/404,952, 2007, Kuhn et al.
U.S. Appl. No. 11/505,748, 2008, Kuhn et al.

* cited by examiner

EXAMPLE BETTING AND PAYOUT SCHEMA

PICK-IT POKER

BACKGROUND

Multi-stage card games have gained some popularity in gambling establishments because the stages add variety, increase opportunities for players to win wagers, and increase opportunities for the gaming establishment to collect bets. Typically during play of a multi-stage card game, bets apply to the outcome of selected stages of the game flow, according to relevant payout schedules customized for each stage.

U.S. Pat. No. 7,389,990 to Mourad entitled, "Method of Playing a Card Game Involving a Dealer" describes a multi-stage card game in which the dealer controls the cards dealt and played at each stage. What is needed is a multi-stage card game in which the player has more freedom and latitude over the elements of chance inherent in card games.

SUMMARY

A multi-stage card game includes stages at which each player selects which unrevealed cards are to be played. In one implementation, bets are received for at least some stages of a multi-stage poker-like game. Cards are dealt into an unrevealed dealer hand and an unrevealed player hand for each player. For at least one of the stages, each player selects one of the cards from the player's unrevealed hand to reveal in order to access a progression of payout schedules. Each player's hand accumulates player-selected cards across the stages of the game and across associated payout schedules, until all cards are revealed. A player's poker hand is then compared to the dealer's poker hand for potential payout. Opportunities for bonus bets are also interjected into implementations of the game.

This summary section is not intended to give a full description of Pick-It Poker, or to provide a list of features and elements. A detailed description of example embodiments follows.

DETAILED DESCRIPTION

Overview

This disclosure describes Pick-It Poker games. Pick-It Poker is a moniker given to variations of a betting game that may use real or virtual playing cards. In one implementation, the Pick-It Poker game is a multi-stage poker game in which players select or "pick" which cards in their unrevealed card hands are to be played at certain stages of the game. Different stages may have different payout schemes, various betting options, and various game flow branches. The stages of the game are directed to forming a final poker hand, which under certain conditions determines a payout based on the ante by comparing the player's poker hand to the dealer's poker hand and applying a payout scheme. Other payout schemes are applied to at least some of the stages that precede formation of the final poker hand.

Versions of the Pick-It Poker game may be played manually or on a computing device, such as on an electronic game table that uses real or virtual playing cards and/or real or virtual betting chips. Example game devices and electronic game tables on which the Pick-It Poker game can be played are described in U.S. Pat. No. 5,586,766 and U.S. Pat. No. 5,934,998 to Forte et al.; and U.S. Pat. No. 6,165,069, U.S. Pat. No. 7,048,629, and U.S. Pat. No. 7,255,642 to Sines et al., each of these incorporated herein by reference.

Exemplar Implementations of the Pick-It Poker Game

In one implementation, Pick-it Poker is a house-banked five card poker game involving a dealer hand and at least one player hand. In other implementations, the Pick-It Poker game can be played with other size hands, such as two-card, three card, four card, six card, or seven card hands.

Figure 1:
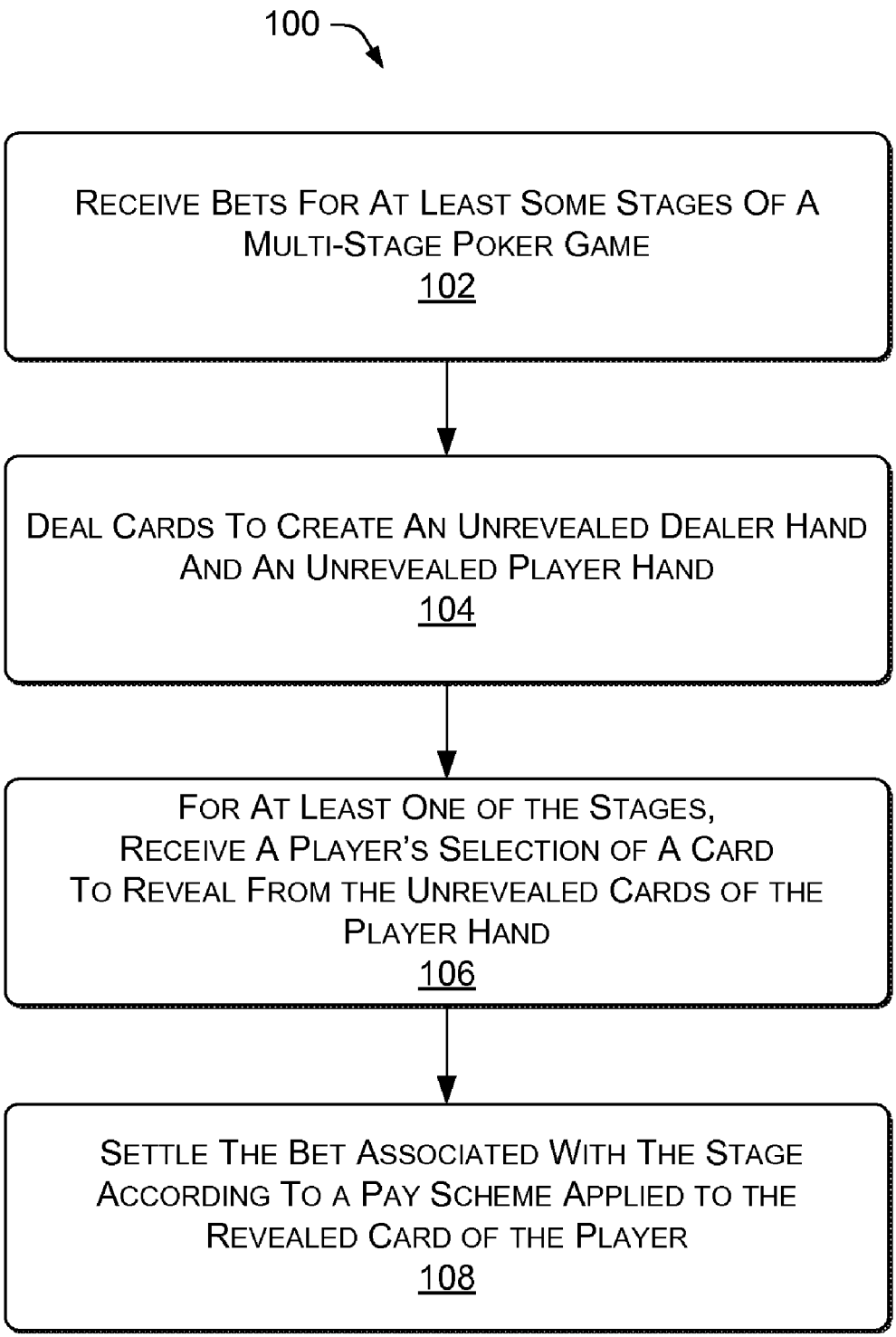
FIG. 1 is a flow diagram of an exemplary method of playing a multi-stage poker game in which each player selects which unrevealed card to play during at least one stage.

FIG. 1 shows part of an exemplary Pick-It Poker game flow 100. In the flow diagram, the operations are summarized in individual blocks. The exemplary game flow 100 may be performed manually, or by combinations of hardware and software, for example, by components of the processors, gaming engines, and/or electronic game tables described in the patent references cited above.

At block 102, bets are received for at least some stages of the multi-stage poker game.

At block 104, cards are dealt to create an unrevealed dealer hand and an unrevealed player hand. Multiple players can play, and in some implementations, at some stages of the game, the players play their respective hands against the dealer's hand.

At block 106, for at least one of the stages of the game, a player's selection of a card to reveal from the player's unrevealed hand is received by the dealer, or by a game processor. The dealer or processor reveals the card. In some implementations, the player reveals the player's own selected card.

At block 108, a bet associated with the game stage at which the player's card was revealed is settled. Settlement of the bet may depend on the card meeting a threshold, or the dealer's hand or revealed cards meeting a threshold. If the player's revealed card meets the threshold, then a payout scheme is applied, but if not then the player's bet is collected by the house. In one implementation, if the dealer's hand does not meet a threshold, then the settlement of the bet for that particular game stage may be pushed, i.e., skipped. When settlement of the bet is pushed, then it is as though the bet had not been placed—no money is transferred in either direction.

Figure 2:
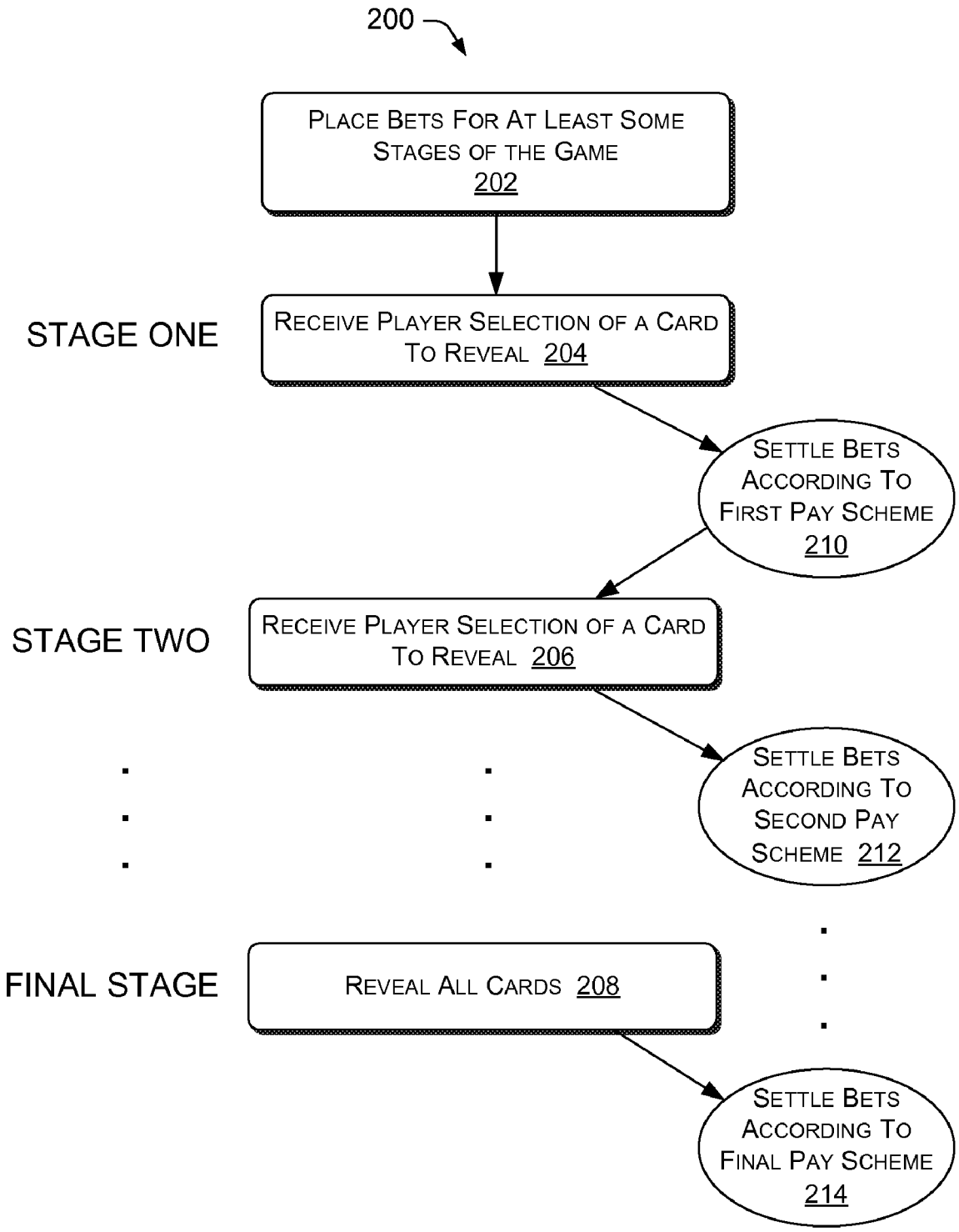
FIG. 2 is a diagram of a relation between player card selection at different stages of the multi-stage poker game and settlement of respective bets associated with each stage.

FIG. 2 shows another exemplary game flow 200. The exemplary game flow 200 generalizes interplay between each game stage and settlement of the bets placed for that game stage. Each stage consists of the player(s) selecting one or more of the unidentified cards in the player's unrevealed hand to reveal, and a subsequent settlement of the bets placed for that stage. The terms "unidentified" and "unrevealed," as used herein, refer to cards that have an identity unknown to the dealer, unknown to the player, and unknown to the other players. As introduced above, the settlement of bets for a game stage may consist of applying a threshold criterion to the revealed card(s) to determine if a payout scheme applies to the cards revealed, and then executing the payout scheme when it applies. Or, the settlement may consist of comparing the revealed card or the cumulative revealed cards in the player's hand to revealed cards in the dealer's hand to determine if a payout applies.

In one implementation, one or more players place bets 202 for at least some of multiple stages of the game. For each stage 204, 206, . . . , 208 each player picks a card (or cards) from their own unrevealed hand to reveal 206. In each game stage, the bets placed for that stage are settled according to respective payout schemes 210, 212, 214 as applied to the card or cards revealed for that stage, or to the cards revealed cumulatively across the current and preceding game stages.

Figure 3:
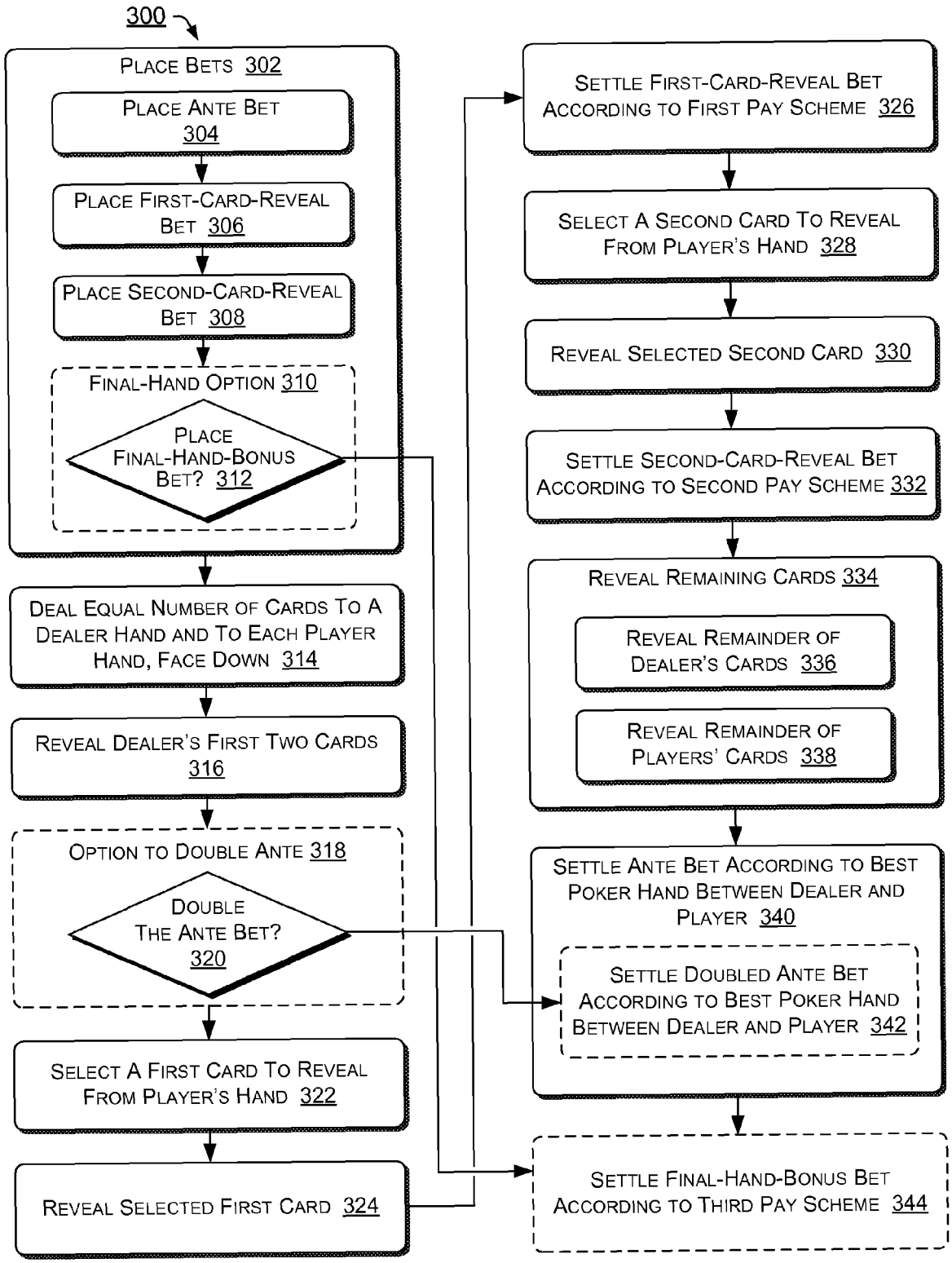
FIG. 3 is a flow diagram of an exemplary method of playing a multi-stage poker game in which players select which unrevealed cards to play during some stages.

FIG. 3 shows another exemplary method 300 of playing the Pick-It Poker game. In the flow diagram, the operations are summarized in individual blocks. The exemplary method 300 may be performed manually, or by combinations of hardware and software, for example, by components of the processors, gaming engines, and/or electronic game tables described in the patent references cited above, such as U.S. Pat. No. 6,165,069, U.S. Pat. No. 7,048,629, and U.S. Pat. No. 7,255,642 to Sines et al., each of these incorporated herein by reference.

At block 302, the players place bets for at least some stages of the game, similar to steps 102 and 202 in FIGS. 1-2. In one implementation, each player places a minimum of three bets: an ante bet 304, a first-card-reveal bet 306, and a second-card-reveal bet 308. In one implementation, the players may also choose a final-hand option 310 in which they place a final-hand bonus bet 312. For example, the optional final-hand bonus bet 312 may be equal to the ante amount 304.

Figure 4:
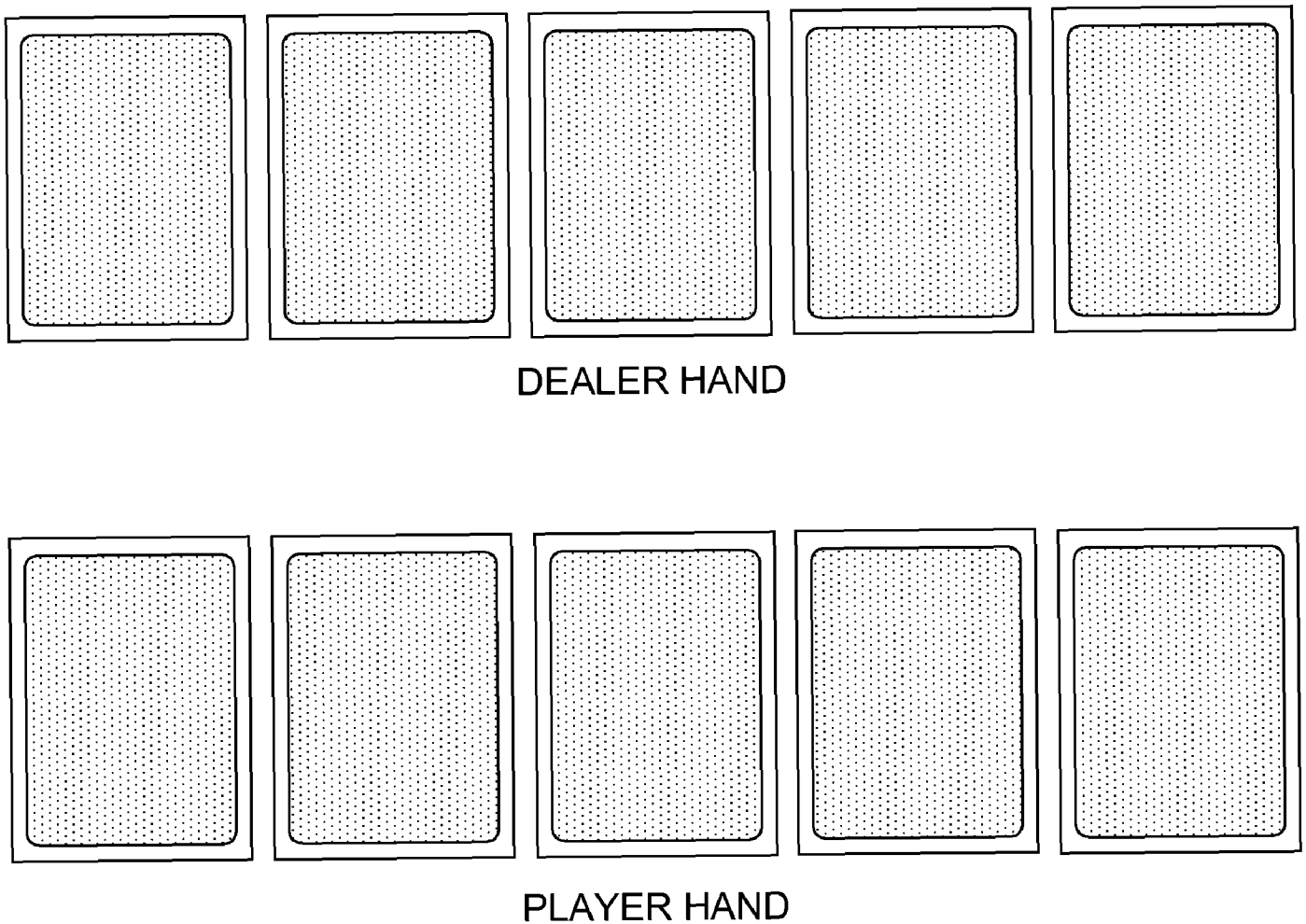
FIG. 4 is a diagram of an unrevealed dealer hand and an unrevealed player hand.

At block 314, an equal number of cards are dealt "face down" to the dealer and to each player, as shown in FIG. 4. "Face down" means that neither the dealer nor any players knows the identity of the unrevealed cards. In one implementation, five card hands are dealt to the dealer and to each player. In other implementations, 2, 3, 4, 6, or 7 card hands may be used instead of five card hands. In one implementation, the dealer's cards are dealt and initial dealer cards are revealed first, before the players' cards are dealt.

Figure 5:
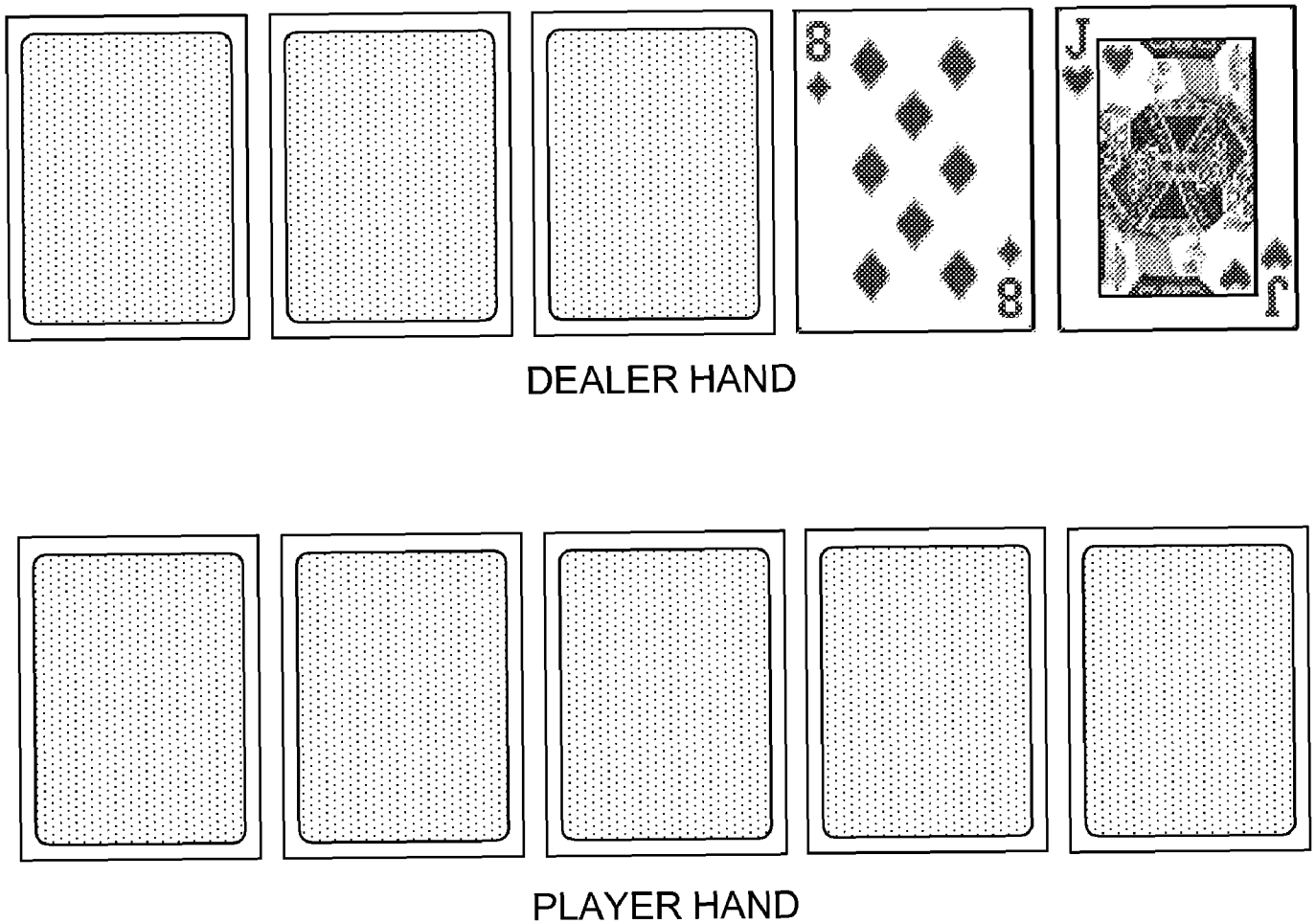
FIG. 5 is a diagram of a dealer hand in which two-cards are initially revealed, before players pick cards to play.

At block 316, in a five card hand implementation of the method 300, the dealer reveals the first two-cards of the dealer's hand, as shown in FIG. 5, or the cards are revealed automatically. When the dealer hand contains a different number of cards than five, then a different number of initial cards may be revealed at this step. In a variation, the dealer's hand contains five cards (or some other number of cards) but more than two or less than two dealer cards are revealed. For example, alternative implementations reveal a single card, or may reveal two, three, or four cards.

At block 318, after the dealer has revealed, for example, the first two-cards of the dealer's hand, players may choose a further betting option 318 to double the ante 320 based on the dealer's showing cards. The stages of the game are directed to forming a final poker hand that determines the fate of the antes. Thus, at this step (318), each player may judge that the first two-cards of the dealer's hand appear weak, and choose to double the ante bet accordingly 320.

At block 322, each player selects a first card to reveal from the player's hand. The player is free to select any of the cards in the player's hand, because at this point none of the player's cards are yet revealed. In one scenario, all the participating players select a card to reveal from their hands before any of the players' cards are revealed. For example, in an electronic game table implementation, each player designates a first card to reveal and then the dealer actuates a switch or a touch screen icon to reveal all the players' selected cards at once.

Figure 6:
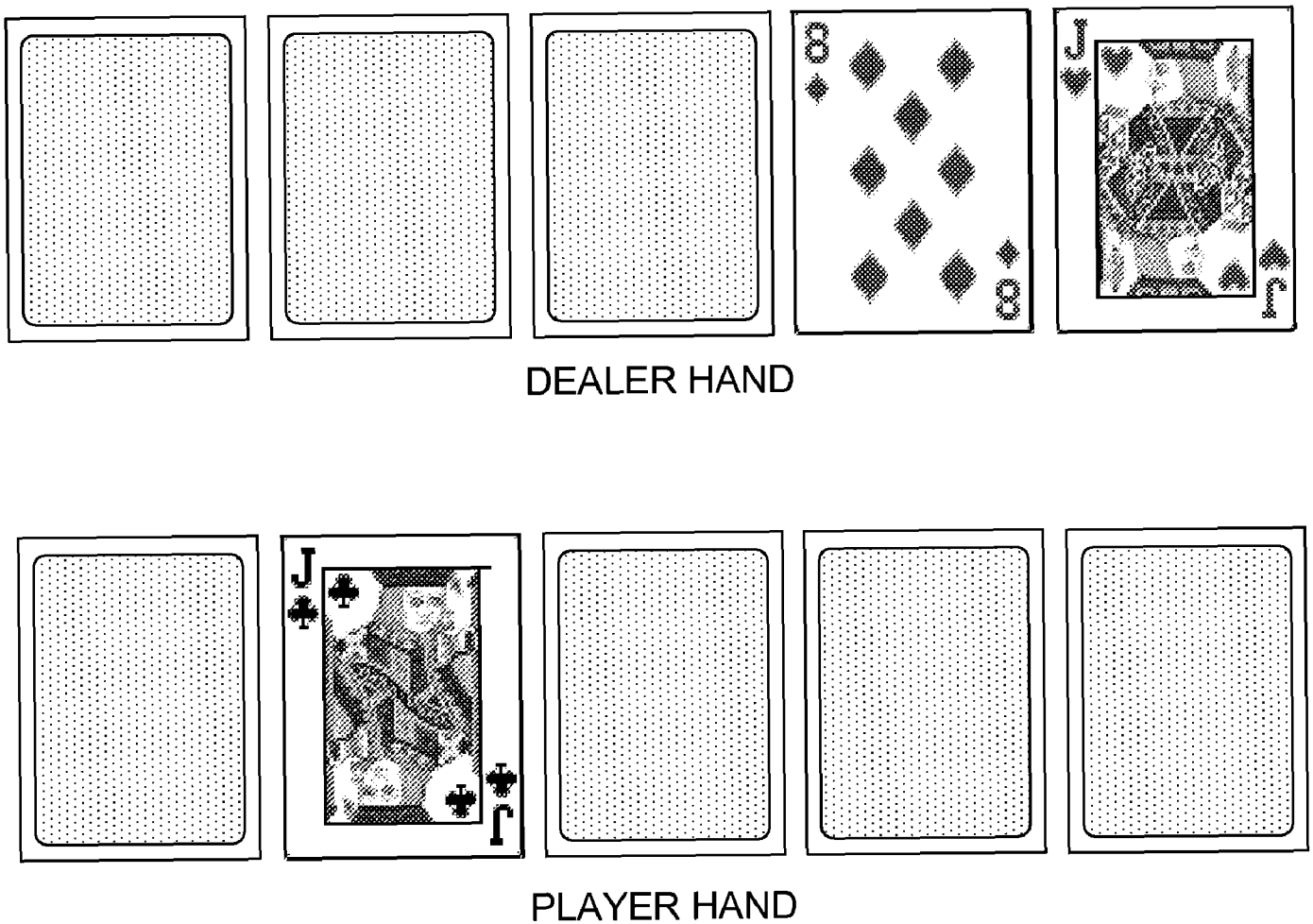
FIG. 6 is a diagram of a dealer hand and a player hand in which the identity of a player-selected card has been revealed.

At block 324, the card selected by each player is revealed, as shown in the example hand in FIG. 6. Depending on implementation, the act of revealing the player-selected card can be performed by a dealer, or by the player, by an electronic game device, or by a dealer actuating a switch of the electronic game device, such as a touch-screen display of an electronic game table.

At block 326, the first-card-reveal bet 306 is settled according to a first pay scheme. In one implementation, the first-card-reveal pay scheme is a payout based on a threshold. For example, if the revealed card has a denomination of "9" or higher, then the card pays 1:1 of the amount bet in the first-card-reveal bet 306, as shown in the first pay scheme below:

Example First-Card-Reveal Pay Scheme

Pay 1 to 1 for a card of denomination 9 or higher

This pay scheme is only one example, many other first-card-reveal pay schemes can be used. In the player's hand shown in FIG. 6, the revealed jack card pays 1:1 on the amount placed by the player for the first-card reveal bet 306.

At block 328, each player selects a second card to reveal from the as-yet unrevealed cards in the player's hand. The player is free to select any of the cards remaining unrevealed in the player's hand. In one scenario, all the participating players select a second card to reveal from their hands (e.g., four remaining unrevealed cards) before any of the players' cards are revealed. For example, in an electronic game table implementation, each player designates a second card to reveal and then the dealer actuates a switch or a touch screen icon to reveal all the players' selected cards at once.

Figure 7:
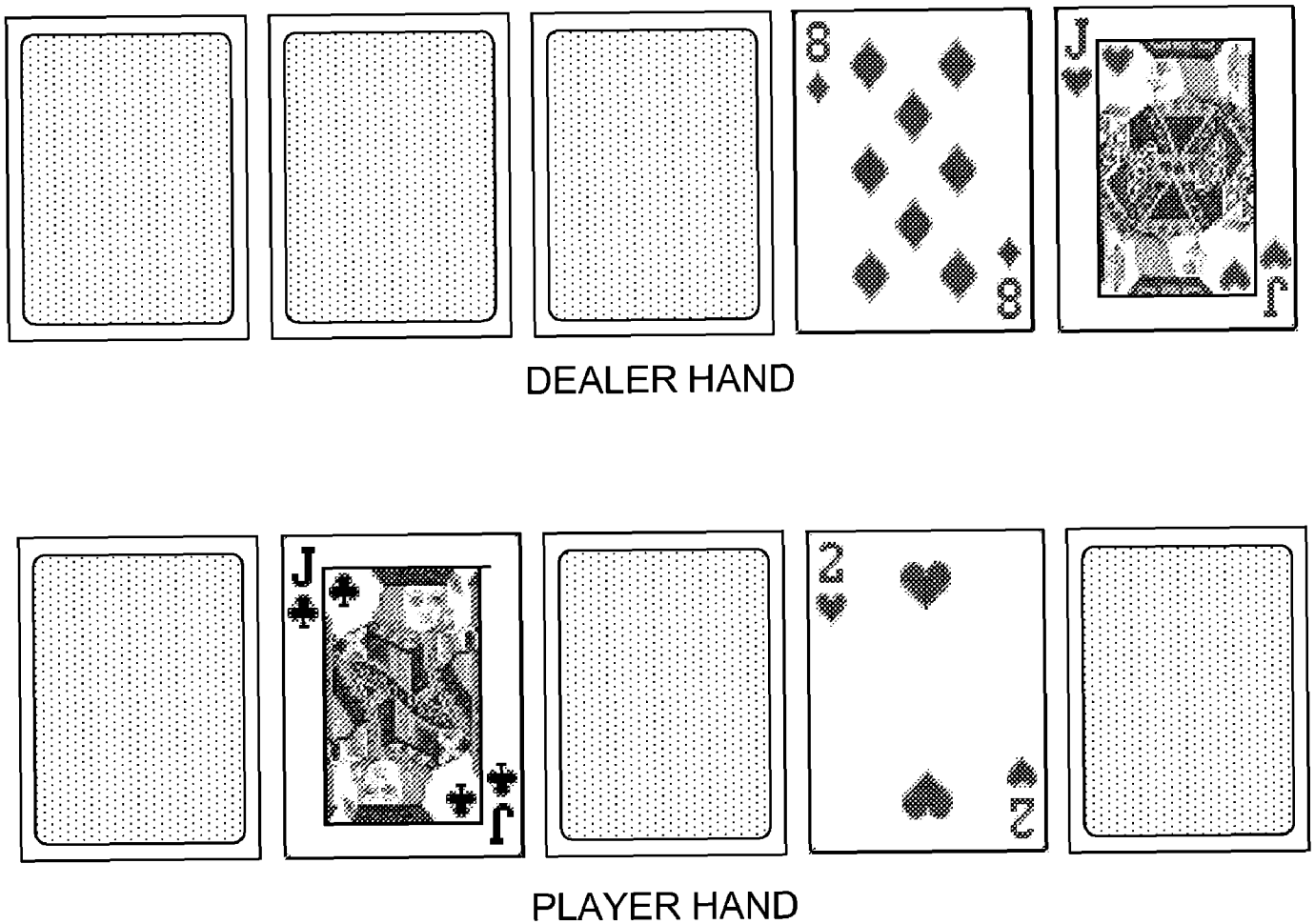
FIG. 7 is a diagram of a dealer hand and a player hand in which the identity of two player-selected cards have been revealed.

At block 330, the second card selected by each player is revealed, as shown in FIG. 7. As above in step 324, the act of revealing the player-selected card can be performed by a dealer, or by the player, by an electronic game device, or by a dealer actuating a switch of the electronic game device, such as a touch-screen display of an electronic game table.

At block 332, the second-card-reveal bet is settled according to a second pay scheme. Since there are now two playing cards revealed in the player's hand, the payout scheme can be more elaborate than when only one card was revealed. In one implementation, the player's two revealed cards are not compared with the dealer's two revealed cards, but are compared with a payout schedule that applies to the player's two revealed cards themselves. An example second pay scheme is shown below, and is applied to the second-card-reveal bet 308:

Example Second-Card-Reveal Pay Scheme

Pay 1 to 1 for a two-card Flush or Straight
Pay 3 to 1 for a Pair
Pay 4 to 1 for a two-card Straight Flush This pay scheme is only one example, many other second-card-reveal pay schemes can be used. In most implementations, only the single highest payout amount that a player qualifies to win under the second-card reveal pay scheme is paid to the player. In other words, a 4 to 1 payout for a two-card straight flush does not also qualify the winner for an additional 1 to 1 payout for the two-card flush taken separately and does not qualify the winner for an additional 1 to 1 payout for the two-card straight taken separately. In the player's hand shown in FIG. 7, the revealed jack card and 2-of-hearts card combination results in a "no win" for the player's second-card-reveal bet 308, and the second-card-reveal bet 308 is collected by the house.

Figure 8:
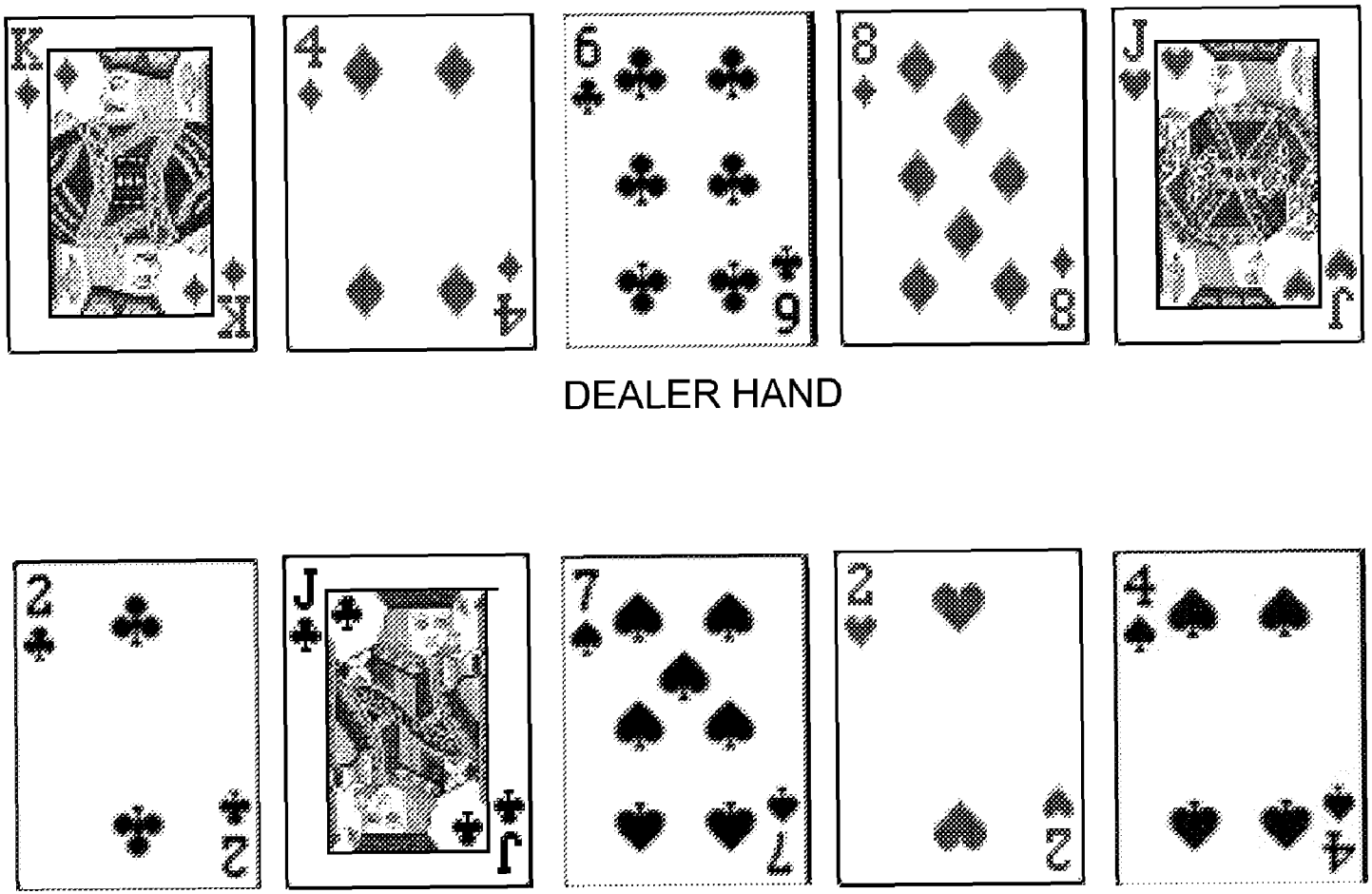
FIG. 8 is a diagram of a dealer hand and a player hand in which the identity of all the cards have been revealed.

At block 334, the remaining cards are revealed, as shown in FIG. 8. That is, the remaining dealer cards are revealed 336 and the remaining player cards are revealed 338. At this point in the game, all of the cards are now showing, and none are still unrevealed.

At block 340, the ante bet 304 is settled according to the best poker hand held by the dealer or the player. When there are multiple players, some players' poker hands may beat the dealer's poker hand, and some may not. In one implementation, a player's winning poker hand pays 1:1 of the amount of the ante bet 304. In another or the same implementation, the dealer's poker hand must be at least king-high in order for the dealer's hand to qualify for settlement of the ante bet 304. If the dealer's hand is unqualified, then the ante bet 304 is pushed and optional doubled ante bets 304 are also pushed. An example final-hand payout scheme is shown below:

Example Final-Hand Ante Bet Payout Scheme

Pay 1 to 1 on the ante bet when the Player's poker hand beats the Dealer's poker hand and the Dealer's poker hand is qualified by being king-high or better In the player's hand shown in FIG. 8, the player's pair-of-2's beats the dealer's hand, which is merely king-high, so the player is paid 1:1 on the ante bet 304 or paid 1:1 on a doubled ante bet 320. In one implementation, if the dealer's hand is not at least king-high, then the ante bet 304 and double ante bets 320, if any, are pushed (no action taken on the bets). Many other criteria to qualify the dealer's hand can be used instead of the "king-high" criterion.

At block 342, the optional doubled ante bet 320 is also settled in the same manner as the regular ante bet 304. That is, if the player's poker hand beats the dealer's poker hand, then the player wins 1:1 on the doubled ante bet, instead of winning 1 to 1 of the regular ante bet 304.

Again, when the dealer's poker hand is not qualified (e.g., is not king-high) then the regular ante bet 302 or the doubled ante bet 320 are pushed (i.e., ignored—as if the ante bet or double ante bet were not placed).

At block 344, the optional final-hand-bonus bet 312, if placed by a player, is settled according to a third pay scheme. In one implementation, settlement of the final-hand-bonus bet 312 typically does not depend on a comparison of the player's hand to the dealer's hand, but instead is based on a third pay scheme, such as the following:

Example Final-Hand Bonus Bet Pay Scheme

| | |
|---|---|
| 3 Card Flush or Straight | Pays 1 to 1 |
| 3 of a Kind | Pays 2 to 1 |
| 4 Card Flush or Straight | Pays 3 to 1 |
| 4 of a Kind | Pays 4 to 1 |

-continued

| | |
|---|---|
| 5 Card Flush | Pays 5 to 1 |
| 5 Card Straight | Pays 8 to 1 |
| 4 Card Straight | Pays 5 to 1 |
| 5 Card Straight Flush | Pays 80 to 1 |
| 5 Card Royal Flush | Pays 200 to 1 |

This pay scheme is only one example, many other final-hand bonus bet pay schemes can be used. In most implementations, only the single highest payout amount that a player qualifies to win under the final-hand bonus bet pay scheme is paid to the player. In the player's hand shown in FIG. 8, the revealed player's hand does not pay according to the above-listed final-hand bonus bet payout scheme, and the player's optional final-hand bonus bet 312 is collected by the house.

Figure 9:
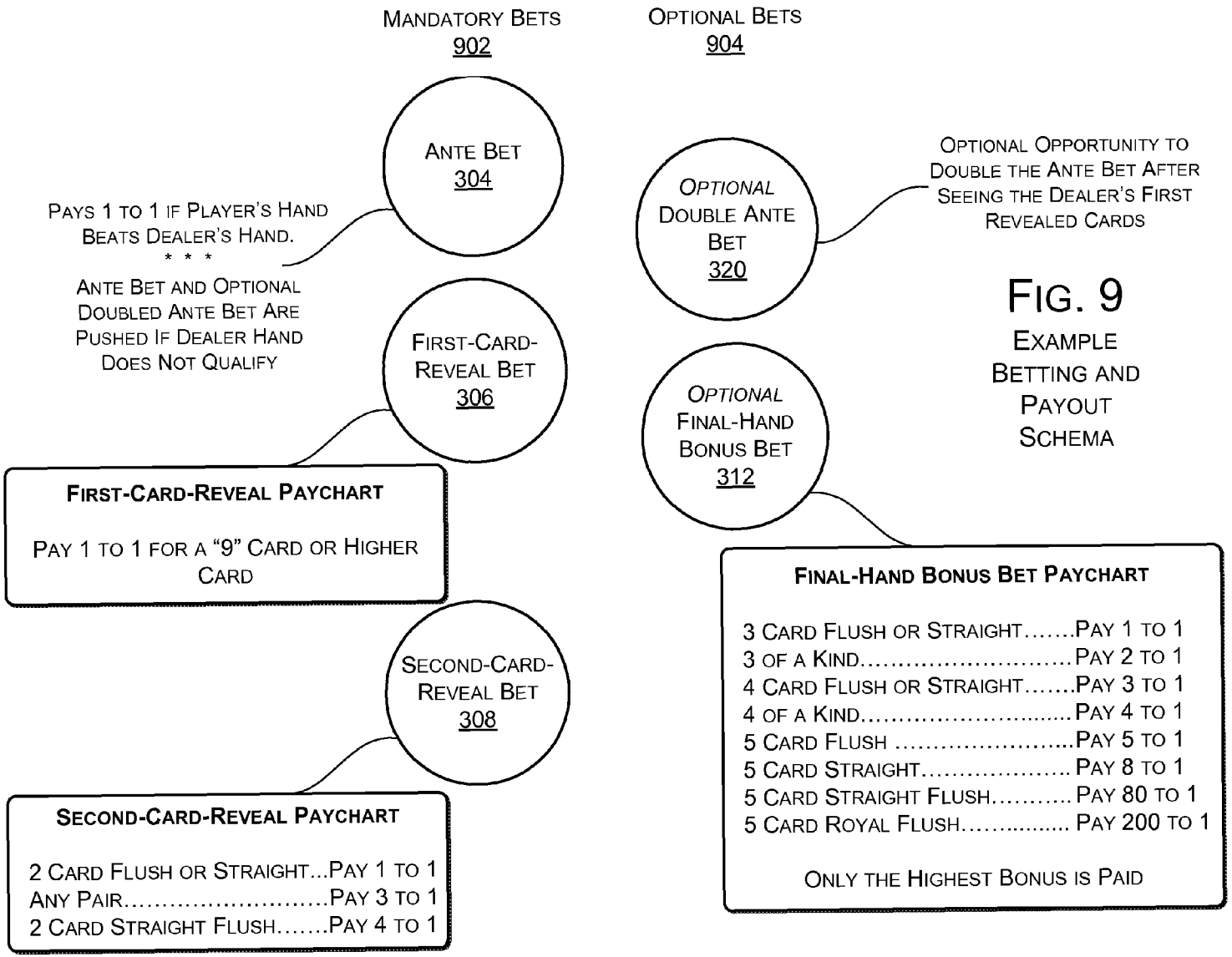
FIG. 9 is a diagram of exemplary betting and payout schemata used in the exemplary multi-stage poker game.

FIG. 9 shows exemplary betting and payout schemata for an implementation of the Pick-It Poker game. Mandatory bets 902 are shown grouped together and optional bets 904 are shown grouped together. In one implementation, the mandatory bets 902 include the ante bet 304, the first-card-reveal bet 306, and the second-card-reveal bet 308. In one implementation, the optional bets 904 include doubling the ante bet 320 and the final-hand bonus bet 312. Example payout schemes for the different kinds of bets are shown. If a player's card or hand does not qualify for a payout according to the pay scheme in play, then the player's bet is typically collected by the house. If the dealer's hand does not qualify once all the cards are revealed (e.g., in one implementation the dealer's hand qualifies by being king-high) then the ante bet 304 and the optional doubled ante bet 320 are pushed.

CONCLUSION

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. An electronic game table, comprising:

multiple video displays;

a game processor to execute game instructions and create images of virtual game pieces to present on the multiple video displays;

wherein the game instructions include instructions for:

receiving player bets for at least some stages of a multi-stage poker game;

wherein each player places an ante bet, a first-card-reveal bet, and a second-card-reveal bet;

offering to receive a final-hand bonus bet from at least one player, wherein the final-hand bonus bet is equal to or less than the ante bet;

dealing a hand of five cards face down to a dealer hand and to each player hand;

revealing two-cards from the dealer hand;

doubling the ante bet of at least one player selecting to double the ante bet based on the revealed cards from the dealer hand;

for each non-dealer player, receiving a selection of a first card to reveal from the unrevealed cards of the player hand;

settling the first-card-reveal bet based on the selected first card and on a first payout scheme that pays the player 1 to 1 on the first-card-reveal bet when the selected first card has a denomination of nine or higher;

for each non-dealer player, receiving a selection from the player of a second card to reveal from the unrevealed cards of the player hand;

settling the second-card-reveal bet based on the selected second card and on a second payout scheme that pays the player one of 1 to 1 for a two-card flush, 1 to 1 for a two-card straight, 3 to 1 for a pair, or 4 to 1 for a two-card straight flush;

revealing remaining unrevealed cards in the dealer hand and in each player hand;

settling the ante bet or the double ante bet of a player by comparing a first poker hand created by the revealed cards of the player hand with a second poker hand created by the revealed cards of the dealer hand, wherein when the dealer hand is at least king-high and the first poker hand beats the second poker hand then the player is paid 1 to 1 on the ante bet or the doubled ante bet, and wherein if the dealer hand is not at least king-high, then the ante bet or the doubled ante bet is pushed;

for each player placing a final-hand-bonus bet, settling the final-hand-bonus bet based on the revealed cards of the player hand and on a final-hand-bonus bet payout scheme that pays the player one of:

1 to 1 on the final-reveal bonus bet when the revealed playing cards in the player hand create a three-card flush;

1 to 1 on the final-reveal bonus bet when the revealed playing cards in the player hand create a three-card straight;

2 to 1 on the final-reveal bonus bet when the revealed playing cards in the player hand create a three-of-a-kind poker hand;

3 to 1 on the final-reveal bonus bet when the revealed playing cards in the player hand create a four card flush;

3 to 1 on the final-reveal bonus bet when the revealed playing cards in the player hand create a four card straight;

4 to 1 on the final-reveal bonus bet when the revealed playing cards in the player hand create a four-of-a-kind poker hand;

5 to 1 on the final-reveal bonus bet when the revealed playing cards in the player hand create a five card flush;

8 to 1 on the final-reveal bonus bet when the revealed playing cards in the player hand create a five card straight;

80 to 1 on the final-reveal bonus bet when the revealed playing cards in the player hand create a five card straight flush; and 200 to 1 on the final-reveal bonus bet when the revealed playing cards in the player hand create a five card royal flush.

* * * * *